United States Patent [19]

Kent

[11] Patent Number: 5,061,106

[45] Date of Patent: Oct. 29, 1991

[54] TOOTHBRUSH WITH SLOW RELEASE OF DISINFECTANT AND ANTIBACTERIAL AGENTS AND METHOD OF MANUFACTURING THE SAME

[75] Inventor: Steven Kent, Stockport, England

[73] Assignee: Colgate-Palmolive Company, Piscataway, N.J.

[21] Appl. No.: 432,326

[22] Filed: Nov. 6, 1989

Related U.S. Application Data

[63] Continuation of Ser. No. 165,650, Mar. 8, 1988, abandoned.

[51] Int. Cl.[5] ..... A46B 11/00; A46B 11/04

[52] U.S. Cl. ..... 401/268; 15/104.94; 300/21; 401/283; 401/290

[58] Field of Search ..... 15/104.94, 191 R, 167.1, 15/159 A, 192, 194; 401/268, 41, 291, 40, 283, 290; 300/21; 132/308

[56] References Cited

U.S. PATENT DOCUMENTS

| | | | |
|---|---|---|---|
| 846,900 | 3/1907 | Bloom | 15/104.94 X |
| 1,492,360 | 4/1924 | Davis | 15/104.94 |
| 1,798,081 | 3/1931 | Gordyn Jr. et al. | 401/283 |
| 1,995,374 | 3/1935 | Young | 401/268 |
| 2,216,333 | 10/1940 | White et al. | 401/268 |
| 2,303,667 | 12/1942 | Taborski | 15/104.94 X |
| 2,686,326 | 8/1954 | Leathers | 15/104.94 |
| 2,807,818 | 10/1957 | Taylor | 401/269 |
| 2,976,554 | 3/1961 | Hromoko et al. | 132/84 R |
| 3,129,449 | 4/1964 | Cyzer | 132/308 X |
| 3,165,776 | 1/1965 | Tuseth | 401/132 |
| 3,378,870 | 4/1968 | Matsunaga | 401/268 |
| 3,598,123 | 8/1971 | Zaffared | 401/132 X |
| 3,679,102 | 7/1972 | Charle et al. | 401/132 X |
| 4,071,614 | 1/1978 | Grim III. | 424/49 |
| 4,346,493 | 8/1982 | Goudsmit | 15/167.1 X |
| 4,837,007 | 6/1989 | Duckworth | 424/52 |

FOREIGN PATENT DOCUMENTS

| | | | |
|---|---|---|---|
| 451728 | 11/1927 | Fed. Rep. of Germany | 401/268 |
| 794836 | 2/1936 | France | 15/191 R |
| 1038738 | 5/1953 | France | 401/291 |
| 641913 | 7/1962 | Italy | 401/268 |
| 185884 | 9/1922 | United Kingdom | 401/268 |
| 259268 | 10/1926 | United Kingdom | 15/104.94 |
| 273366 | 7/1927 | United Kingdom | 15/167.1 |
| 490841 | 11/1936 | United Kingdom | 15/104.94 |

OTHER PUBLICATIONS

"Serum Albumin Beads" Science vol. 213 Jul. 1981.

*Primary Examiner*—Steven A. Bratlie
*Attorney, Agent, or Firm*—Richard J. Ancel; Robert C. Sullivan

[57] ABSTRACT

A toothbrush has a head with tuft holes for the reception and retention of bristles therein. The tuft holes contain self-contained structures therein for the slow release of disinfectant or medication over repeated brushings. The release structure can be a capsule, a tablet, or a plurality of different timed-release microcapsules in the bottom of the tuft holes, or a coating of the agent formed on the anchor used to hold the bristles in the tuft holes.

2 Claims, 2 Drawing Sheets

TOOTHBRUSH WITH SLOW RELEASE OF DISINFECTANT AND ANTIBACTERIAL AGENTS AND METHOD OF MANUFACTURING THE SAME

"This is a continuation of co-pending application Ser. No. 07/165,650 filed on Mar. 8, 1988." now abandoned.

BACKROUND

Health care costs are increasing dramatically in the United States and other countries. A significant component of these escalating costs is tooth and gum disease.

Advances in dentrifice compositions and modalities for treatment of peridontal disease have greatly assisted in the prevention and treatment of these conditions.

However, the primary tool for every day cleaning of teeth remains the common toothbrush. Since the toothbrush frequently comes into contact with the oral environment and may be subsequently left in a non-sterile environment until subsequent use, the toothbrush bristles can harbour bacteria and upon re-use of the toothbrush, the bristles can become a source for introducing bacteria into the oral cavity.

Additionally, the toothbrush has not been used as a source of medication but, rather, as an applicator for dentrifrice. There would be merit in using the toothbrush as such a medication source, preferably as a complement to the dentrifice if a viable and practical low-cost means for doing so could be found.

Although the technical problem of designing a toothbrush capable of delivering dentrifice and other agents has long been recognized, no satisfactory workable system has been developed to meet this long-felt need.

The prior art illustrates that this is so. For example, U.S. Pat. No. 914,501 is an early approach wherein a reservoir is formed along the sides of the bristles to contain liquid dentrifice. This disclosure fails to provide long-lasting means for release of dentrifice or other agents since the liquid dentrifice would be washed from the oral cavity with each use.

Another attempt to solve the problem is disclosed in U.S. Pat. No. 1,238,883 wherein the "bristles" of the brush are vulcanized rubber and incorporated polishing and cleaning substances.

In U.S. Pat. No. 1,214,556 a cotton insert containing dentifrice is placed in the brush. This is believed to be impractical as it would require consumers to undertake the cumbersome task of replacing inserts after every use. A similar insert device is described in U.S. Pat. No. 4,588,089 wherein an envelope containing toothpaste is inserted in a toothbrush and released by a spike. This technique is also employed in U.S. Pat. No. 3,316,580 which suggests the use of an envelope disposed between the bristles. Such devices requiring inserts are complicated to use.

Similar reservations would apply to U.S. Pat. No. 4,453,679 in which the handle of the toothbrush has a separate attachment for releasing various agents. Indeed, the handle-dispensing approach is the subject of a number of earlier efforts to solve the problem such as U.S. Pat. Nos. 1,896,982; 2,077,758 and 2,303,667, plus U.K. Pat. 259,268.

Another approach believed to be unsuccessful is to coat or to spray the bristles with various agents. Representatives of this group are U.S. Pat. Nos. 1,982,660; 3,302,230; 3,691,585 and Canadian Patent 549,168.

It is evident from examination of the above patents that none of the devices solves the twin problems of maintaining bristles of the toothbrush sterile in a practical manner and providing a viable slow release mechanism for anti-bacterial agents or other medications.

A different approach is shown in British Pat. 259,268 wherein a disinfectant is disposed to communicate with the tuft holes of the bristles. However, even in FIGS. 7–9 of the patent, the reservoir is not located within the tuft holes themselves, nor is there any suggestion of the use of medications other than disinfectants. Importantly, this patent fails to teach how the material to be transferred to the bristles is, in fact, so communicated thereto and absorbed by them. In view of the fact that virtually all toothbrushes on the market today employ hydrophobic plastic bristles, it is not understood how the device of this patent would operate to transfer disinfectant or other medications up through the bristles of such modern toothbrushes.

FIG. 3 of U.K. Patent 1,026,738 discloses recesses 6 disposed annularly around the upper interior perimeter of tuft holes 4 to provide a source of dentrifice when the brush is immersed in water. This patent, again, fails to teach how a long-lasting source of disinfectant and/or other medications can be maintained over extended periods or be absorbed by the bristles over such long periods, i.e., over a period of extended use, as opposed to prior art teachings which disclose systems which would be effective for only a single use.

It is an object of this invention to provide a toothbrush so designed that it will incorporate means for maintaining the brush sterile over long periods.

It is another object of this invention to provide a toothbrush which is capable over long periods of time of releasing anti-bacterial agents and other medications.

It is yet another object of the invention to provide disinfectants and/or other materials in slow-release form incorporated in the toothbrush structure so that the materials are released through the bristles over extended time periods to keep the toothbrush sterile and clean and, if medications are used, to assist in the application thereof to the teeth during brushing.

These and further objects of the invention will be observed from the following detailed description, the drawings and the claims.

DETAILED DESCRIPTION

As indicated, it is known that toothbrushes of conventional manufacture are not sterile and, in fact, harbour bacteria which transfer into the oral cavity during repeated brushings. Thus, the primary instrument for tooth cleaning itself can be a source of infection within the mouth.

It would be desirable, in addition to eliminating the foregoing infection problem, to provide a toothbrush which is capable of releasing medication effective against tooth and gum disease over extended periods of time, that is, during multiple uses of the toothbrush.

Certain of the prior patents discussed above recognize the problem of toothbrush sterility and the desirability of using the toothbrush to deliver medication.

The solution to these long-recognized needs is the device of the present invention wherein disinfectant, medication or a mixture thereof is contained in slow-release capsules and the latter, either as a plurality of small capsules, which might be termed "microspheres", or within a single larger element or capsule, is placed within the tuft hole of the toothbrush head prior to the placement of the bristles therein. Subsequently, during repeated brushings, the water and saliva present in the oral cavity during brushing seeps into the tuft holes and causes the release of measured amounts of the disinfectant and/or medication. These agents travel up the tuft hole and out of it and into the oral cavity during brushing. Moreover, at the end of brushing, there is sufficient disinfectant remaining on the bristles and toothbrush head and adjacent portions of the handle to sterilize the same so that bacteria will not build up on the brush and contaminate the mouth upon succeeding toothbrushings over an extended period of time, say about 2 to 3 months.

Figures 1A, 1B:
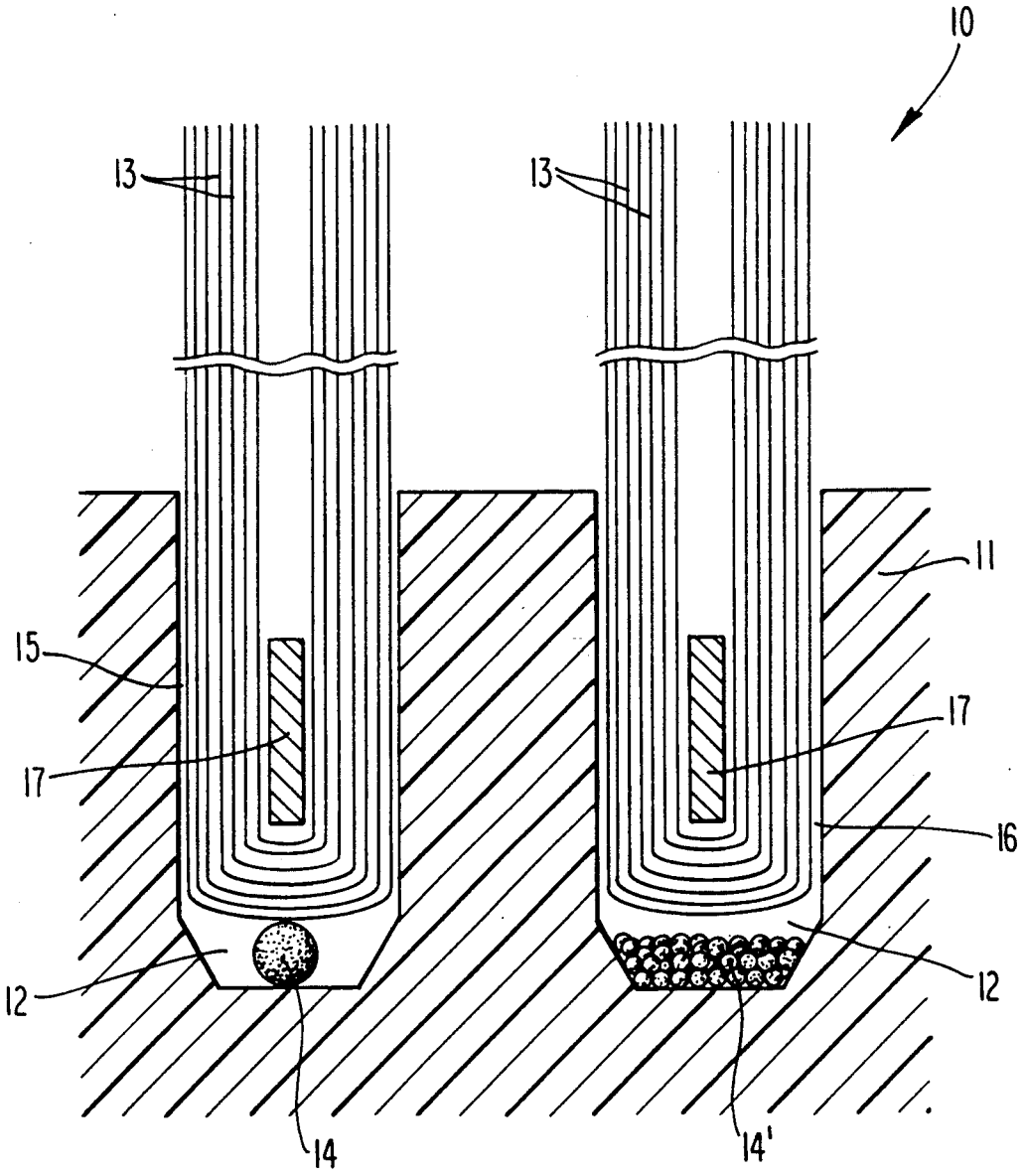
FIGS. 1A and B are schematic cross-sectional illustrations of a toothbrush head in accordance with the invention which includes a chamber for housing slow release disinfectant and antibacterial agents.

FIGS. 1A and B of the drawings show, in schematic form, a cross-section of a portion of the head of a toothbrush suitable for the present invention. Thus, the device is generally designated 10 and has a brush head 11. Two tuft holes for the bristles, 15 and 16, are depicted in brush head 11.

As shown the bristles or filament 13 are inserted into the holes 15 and 16, most commonly by an anchor 17, typically composed of aluminum or an alloy such as brass or silver-nickel.

In the present invention, the tuft holes are particularly designed to incorporate a chamber or additional area 12 below the bottom of the bristles. Within the chamber 12 there are placed slow-release capsules of disinfectant and/or medication. Thus, within chamber 12, there is placed a large unitary capsule 14 having a number of microspheres therein or, alternatively, being one large element capable of slow release of its contents. Within chamber 12', a plurality of relatively smaller capsules 14' of the slow-release type are placed. It will be understood that the capsules 14 and 14' are placed in the tuft holes during manufacture of the toothbrush prior to the insertion of the bristles 13.

Although the bristles are tightly anchored there is still ample room left within the tuft hole, circa. 20–30%. Otherwise in the tufting operation the force of insertion of filaments and anchor wire would cause the cracking of the plastic around the hole. The space left may be expected to have fluid present during and after brushing. There will be also a film of water on the filaments. Thus, by capillary action, the active ingredient can come into contact with the filaments as well as the area in the tuft hole where the microspheres are located. Though nylon can be considered hydrophobic the preferred material, nylon 6.12 still absorbs about 1–2% w/w water.

In operation, the toothbrush is employed in the usual fashion, i.e., dentifrice is applied to the bristles and the brush is inserted into the oral cavity for brushing. The water and saliva generated during this process cause measured amounts of disinfectant and/or medication to pass from their capsule enclosures and up along the bristles out of the tuft holes and into the mouth. At the end of brushing, sufficient disinfectant remains on the bristles to render the same sterile, thereby preventing the formation of bacterial colonies and fungal growth which, in the case of prior art toothbrushes, infect the oral cavity when the toothbrush is next used.

In the case of the smaller capsules 14', the microspheres, a preferred size is on the order of about 75–500 microns in diameter. Both capsules 14 and 14' are of the slow-release type and, as such, may be of natural or synthetic polymers, e.g., gelatin, polyvinylpyrrolidone and hydroxyethylmethacrylate.

As disinfectants to kill bacteria and fungal colonies on the bristles and brush, antimicrobial agents such as chlorhexidine,2,4,4-trichloro-2-hydroxydiphenyl-ether or bromochlorophene may be employed, as well as other known agents. A wide variety of medicaments effective to destroy bacteria and fungus may be employed, both for the purpose of preventing bacterial/fungus growth on the brush and to deliver such ingredients into the oral cavity.

As for disinfectants/antibacterials, others that could be included are:

1,3- bis(2-ethylhexyl)hexahydra-5-methyl-5 pyrimidineamine
Phenols in general
Trichlorophenyl
Formaldehyde
Quaternary Ammonium compounds
(e.g. Benzalkonium Chloride)
Pyridine Derivatives
(e.g. Cetylpyridinium chloride)
Hexachlorophane Indeed, although the toothbrush of the present invention is well-suited for conventional brushing with a dentrifice, it may be used without the latter and thus be employed as a means of delivering suitable medications into the oral cavity.

The capsules used in the present invention may be one of a number of known types. Generally, these systems are either those which release agents when the capsule wall is ruptured, or those which have wall material which dissolves in contact with water or other liquid. The slow-release type preferred in this invention is a plurality of small microspheres which may be placed in a single outer coating of dissolvable material, as in 14, or placed in the tuft hole in relatively large numbers as in 15. The preferred system is to use a large number of microspheres which have increasing wall thicknesses. In such a system, the microspheres which have the thinnest walls release their contents first—because the thinnest walls dissolve first. Thereafter, microspheres release their contents in increasing order of wall thickness. In this fashion, using suitably configured microspheres, the toothbrush releases disinfectants and medications over long periods and over many brushings. The total duration is a matter of selecting the type, and number of microspheres to be employed.

Another preferred capsule is one formed of synthetic material which is cross-linked. In this type, the rate of release of the agent(s) is determined by their rate of diffusion from the capsule, which is, in turn, controlled by the degree of cross-linking. Further, certain types of cross-linked capsules are essentially solid and swell in water (rather than dissolve), so that pores are created through which the agent(s) can be released. In this type, the rate of release is controlled by the amount of swelling which, in turn, is a function of the degree of cross-linking.

Microspheres can be manufactured by a variety of ways, and include polymer spheres that have varying pore sizes. Microspheres suitable for use in this invention preferably are about 74–500 microns in diameter. The distribution and size of the microspheres dictate the rate of release. Also, larger structures (e.g., 1 mm or so in diameter) can be manufactured via standard tablet manufacturing processes and may include an inner non-absorbable material, giving a "matrix tablet". Whatever means are selected, the release of a drug or similar agent in any system depends on the rate of diffusion, which can be controlled.

References relating to the overall subject of drug release is further covered in the session at the 6th Pharmaceutical Technology Conference, Harrogate, England, April 1986 (some papers published in Pharmaceutical Technology: Controlled Drug Release Vol. I (+II). Ed. M. H Rubenstein, published by Ellis Horwood Ltd. ISBN 0-7458-0178-1). Though the active ingredients are not necessarily drugs the concept is the same.

One method of making suitable microspheres would be via the method used by Lee et al. as set forth in Science 213; 233–234, 1981, which involves mixing gelatine and an active ingredient with water which is then added to an oil phase to produce spheres of gelatine/active ingredient/water. In this system, the speed of mixing controls the size of the spheres. After purification, filtration, etc., the spheres can be cross-linked—at least on their external surfaces—by a glutaraldehyde solution. Thus, in this case, the active ingredient leaches out of the spheres and the rate of release will be dependent on the degree of cross-linking and active concentration, i.e., the amount and strength of the active ingredient.

In one embodiment of the invention, the capsule(s) or tablet(s) are colored with a water-soluble dye and the brush head is visually clear, thereby enabling the user to be aware when the contents of the capsule(s) or tablet(s) have been depleted and, thus, that the sterilization and medicinal efficiency of the brush head is correspondingly depleted, so that the user will know that the toothbrush should be replaced.

Figure 2:
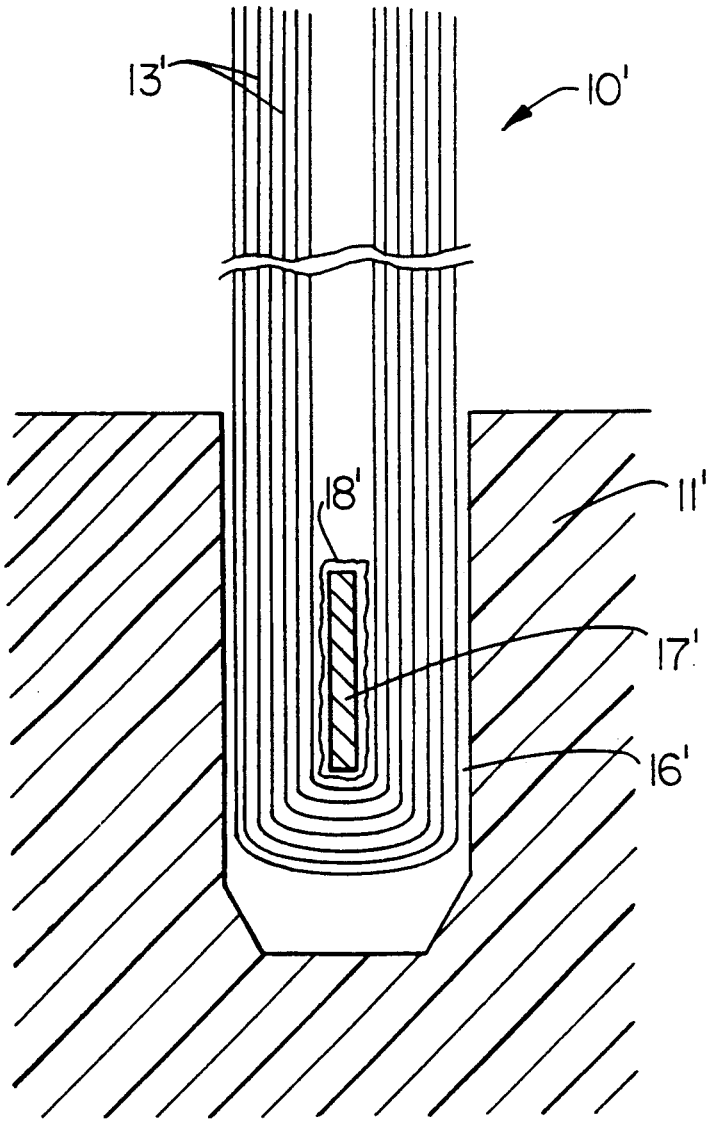
FIG. 2 is a schematic cross-sectional illustration of an alternative embodiment of the toothbrush head including a bristle anchor which is coated with the slow release disinfectant and/or antibacterial agents.

In an alternative embodiment of the invention, illustrated in FIG. 2, a device 10' is provided, which includes a brush head 11', bristles 13', tuft hole 16', and an anchor 17' for securing the bristles in tuft hole 16'. The anchor 17', which may be fabricated of a metal such as nickel-silver, brass, aluminum and the like, includes a coating 18' of the above-described disinfectant and/or antibacterial/antifungal agents.

More particularly, a water-swellable coating 18, or a coating capable of releasing the above agent(s) in concentrations sufficient to achieve the disinfecting and medicinal purposes described when wet, is applied to the metal. For example, the metal anchors are usually derived from a continuous spool of the metal(s) mentioned above and are passed to the tufting machine and cut to size in situ. The coating material may be, for example, a polyvinyl or similar polymer capable of forming a film, e.g., cast from alcohol. The coating can be applied to the spool of metal at the source of manufacture or just prior to the tufting process via a coating bath or spray. To retain sufficient material, a groove may be formed on one or both sides of the metal anchor to hold the coating material.

A variation of the above is to form the metal anchor in two or more strips (not shown) and to apply the coating as a "sandwich" between two of the strips.

Further, the anchor can be made of high strength plastic which then can be coated with the agent(s) described above. Alternatively, such agent(s) can be incorporated in the plastic anchor itself.

I claim:

1. A toothbrush comprising a brush head, said head having a plurality of tuft holes for the reception and retention of respective multiplicities of bristles in the tuft holes, each multiplicity of bristles being attached in a corresponding tuft hole by an anchor, and at least one of said tuft holes containing therein an agent releasing means which is structured for containing an agent and for slowly releasing the agent over repeated brushings, said agent releasing means being activated by entry into said tuft holes of liquid during brushing, said agent being selected from the group consisting of disinfectants and concluded medication, wherein said agent releasing means consists solely of a coating applied on said anchor.

2. A method of manufacturing a toothbrush comprising the steps of forming a brush head with a plurality of tuft holes, providing an anchor which is coated with an agent selected from the group consisting of disinfectants, medications and mixtures thereof, and anchoring a plurality of bristles in one of said plurality of tuft holes by inserting the anchor therein.

* * * * *